US006970667B2

(12) United States Patent
Watanabe et al.

(10) Patent No.: US 6,970,667 B2
(45) Date of Patent: Nov. 29, 2005

(54) DEVELOPING APPARATUS HAVING A SHEET PREVENTING A DEVELOPING AGENT FROM LEAKING OUT OF A CONTAINER OPENING

(75) Inventors: Kazushi Watanabe, Mishima (JP); Toru Oguma, Mishima (JP); Noriyuki Komatsu, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 40 days.

(21) Appl. No.: 10/694,912

(22) Filed: Oct. 29, 2003

(65) Prior Publication Data

US 2004/0126130 A1 Jul. 1, 2004

(30) Foreign Application Priority Data

Oct. 29, 2002 (JP) ..... 2002-314522

(51) Int. Cl.[7] ..... G03G 15/08
(52) U.S. Cl. ..... 399/104
(58) Field of Search ..... 399/102, 103, 399/104, 105, 106

(56) References Cited

U.S. PATENT DOCUMENTS

| | | | | |
|---|---|---|---|---|
| 5,177,536 A | | 1/1993 | Watanabe et al. | |
| 5,404,216 A | * | 4/1995 | Numagami et al. | 399/102 |
| 5,475,467 A | | 12/1995 | Watanabe et al. | |
| 5,697,021 A | | 12/1997 | Watanabe et al. | 399/102 |
| 5,790,923 A | * | 8/1998 | Oguma et al. | 399/106 |
| 6,021,291 A | | 2/2000 | Karakama et al. | 399/104 |
| 6,044,237 A | | 3/2000 | Numagami et al. | 399/104 |
| 6,185,393 B1 | | 2/2001 | Karakama et al. | 399/103 |
| 6,336,014 B1 | | 1/2002 | Sato et al. | 399/103 |
| 6,336,015 B1 | * | 1/2002 | Numagami | 399/104 |
| 6,356,723 B1 | * | 3/2002 | Sato et al. | 399/103 |
| 6,606,469 B2 | | 8/2003 | Kikuchi et al. | 399/104 |

FOREIGN PATENT DOCUMENTS

| | | |
|---|---|---|
| JP | 3-4266 | 1/1991 |
| JP | 8-305164 | 11/1996 |
| JP | 11-133740 | 5/1999 |
| JP | 11-143225 | 5/1999 |
| JP | 2001-22179 | 1/2001 |

* cited by examiner

*Primary Examiner*—Sandra L. Brase
(74) *Attorney, Agent, or Firm*—Fitzpatrick, Cella, Harper & Scinto

(57) ABSTRACT

A developing apparatus includes a container containing a developing agent and having an opening; a developer bearing member provided at the opening of the container; a magnetic sealing member magnetically restricting leakage of the developing agent out of an end of the developer bearing member in a longitudinal direction of the developer bearing member the magnetic sealing member being formed at the end in the longitudinal direction of the developer bearing member as extending along a circumferential direction of the developer bearing member; a sheet member preventing the developing agent from leaking out of the opening of the container, the sheet member being attached along the longitudinal direction of the container forming the opening, the end in the longitudinal direction of a free end of the sheet member entering in a space between the developer bearing member and the magnetic sealing member; and an auxiliary member holding a free end side of the sheet member around the magnetic sealing member. The container is formed with, at a portion attaching to the sheet member, a recess into which the auxiliary member enters.

6 Claims, 15 Drawing Sheets

DEVELOPING APPARATUS HAVING A SHEET PREVENTING A DEVELOPING AGENT FROM LEAKING OUT OF A CONTAINER OPENING

BACKGROUND OF THE INVENTION

1. Field of the Invention

This invention relates to a developing apparatus mounted in an image forming apparatus such as a photocopier or printer and, more particularly, to a developing apparatus having a sheet preventing a developing agent from leaking out of an opening formed at a developing sleeve.

2. Description of Related Art

Referring to FIG. 14 and FIG. 15, a conventional developing apparatus is described. FIG. 14 is a cross section showing a conventional developing frame; FIG. 15 is a diagram showing an end of a developing roller when viewed from Arrow X direction in FIG. 14.

As shown in FIG. 14 and FIG. 15, a prior art has been disclosed in which an elastic member made of a material, such as felt or rubber, is used as a sealing member 114 for sealing a gap between a developing frame 112 and a developing agent carrier, or a developing roller 109*c*, at the opposite ends in the longitudinal direction of the developing roller 109*c* in order to prevent toner from leaking out through the gap between the developing frame 112 of the image forming apparatus and the developing roller 109*c* toward the end in the longitudinal direction of the developing roller. It is to be noted that although in FIG. 14 it is depicted that there is a gap g between the developing roller 109*c* and the sealing member 114, this gap g exists only where a magnetic sealing member as described below is used as the sealing member 114 and does not exist where a sealing member of a contact type, such as a felt or rubber is used. Sealing below the developing roller 109*c* is performed by contacting, with the developing roller 109*c* along the longitudinal direction, a tip of a sheet member 115 formed at the developing frame 112. An end of the sheet member 115 in the longitudinal direction is sandwiched between the developing roller 109*c* and the sealing member made of a material, such a felt or rubber, to prevent toner from leaking out of the end in the longitudinal direction. Rotation torque of the developing roller 109*c* is, in this situation, increased due to sliding contact between the developing roller 109*c* and the sealing member during developing operation.

A sealing member, or magnetic sealing member, has been known, as a sealing member 114 disposed at the end of the developing roller 109*c*, in which a magnet or magnets are placed with a very small gap g along an outer periphery of the developing roller to seal the toner as a magnetic body by magnetic force from the magnet or magnets, as shown in FIG. 14 and FIG. 15(*b*) to reduce the rotational torque. In this situation, the developing roller 109*c* is not in contact with the sealing member 114, and the gap g exists as shown in FIG. 15(*b*). The developing roller 109*c* therefore does not slide on the sealing member 114 during developing operation, thereby reducing the rotational torque of the developing roller 109*c*, and thereby rendering extendable the duration period of the developing roller 109*c*. Such a sealing member is popularly used because it enjoys a merit such that it can be assembled more easily to the developing frame than other sealing members made of felt or rubber.

In a case where such a magnetic sealing member is used, however, the toner may eventually enter in a space between the developing roller 109*c* and the sheet member 115 as shown in FIG. 15(*b*) because the sealing member 114 and the developing roller 109*c* are not in contact with each other. The toner may deposit on the sheet member 115, and a phenomenon h that the deposited toner pushes down the end of the sheet member 115 occurs. If such a phenomenon h occurs, the sealing capability at the end of the developing roller is reduced, and the toner may leak out of the end of the developing roller.

To prevent such a falling-down phenomenon at the end of the sheet member 115, an apparatus is formed with a contact auxiliary member for the sheet member arranged on an inner side in the longitudinal direction of the developing roller with respect to the magnetic sealing portion as disclosed in Japanese Patent Application Publication No. Heisei 11-13374. However, with this apparatus, it is turned out that toner leaking to the exterior of the apparatus exists upon passing through a gap between the auxiliary member and the developing frame and passing through a gap between the magnetic sealing member and the developing frame. Furthermore, another toner leaking to the exterior of the apparatus also exists upon passing through a gap between the sealing member and the magnetic sealing portion.

SUMMARY OF THE INVENTION

This invention is made with regard to the above problems, and it is an object of the invention to provide a developing apparatus capable of suppressing leakage of a developing agent near a magnetic scaling.

It is another object of the invention to provide a developing apparatus comprising: a container containing a developing agent and having an opening; a developer bearing member formed at the opening of said container; a magnetic sealing member magnetically restricting leakage of the developing agent out of an end in a longitudinal direction of said developer bearing member, said magnetic sealing member being formed at the end in the longitudinal direction of said developer bearing member as extending along a circumferential direction of said developer bearing member; a sheet member preventing the developing agent from leaking out of the opening of said container, said sheet member being attached along the longitudinal direction of the container forming the opening, the end in the longitudinal direction of a free end of said sheet member entering in a space between said developer bearing member and said magnetic sealing member; and an auxiliary member holding a free end side of said sheet member around said magnetic sealing member, wherein said container is formed with, at a portion attaching to said sheet member, a recess into which said auxiliary member enters.

It is yet another object of the invention to provide a developing apparatus comprising: a container containing a developing agent and having an opening; a developer bearing member provided at the opening of said container; a magnetic sealing member magnetically restricting leakage of the developing agent out of an end of said developer bearing member in a longitudinal direction of said developer bearing member, said magnetic sealing member being formed at the end in the longitudinal direction of said developer bearing member as extending along a circumferential direction of said developer bearing member; and a sheet member preventing the developing agent from leaking out of the opening of said container, said sheet member being attached with a double side adhesive tape along the longitudinal direction of the container forming the opening, wherein said magnetic sealing member and said sheet member are overlapped with each other, and the double side adhesive tape attaching said sheet member extends to a portion of said magnetic sealing member.

The further objects of the invention will be apparent upon reading the following detailed description with reference to the attached drawings.

DETAILED DESCRIPTION OF THE PREFERRED EMBODIMENTS

Figure 1:
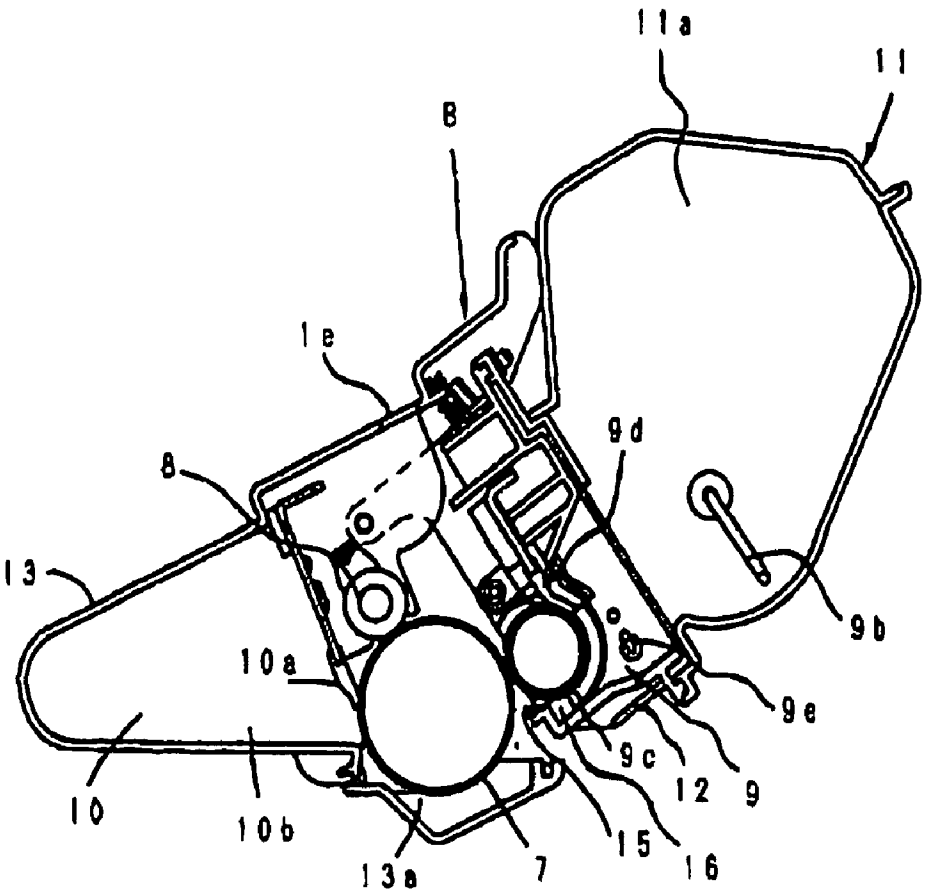
FIG. 1 is a diagram showing a process cartridge incorporating a developing apparatus according to the invention.

Referring to the drawings, embodiments of the invention are described in detail. An electrophotographic image forming apparatus (hereinafter referred to as "image forming apparatus") means what is forming images on recording media using an electrophotographic image forming method. As examples of such an electrophotographic image forming apparatus, electrophotographic photocopiers, electrophotographic printers (e.g., laser beam printers, LED printers), facsimile machines, word processors are used.

A process cartridge is made as a cartridge integrally with an image carrier and any of a charging means, a developing means, and a cleaning means as a processing means operative to the image carrier, and the cartridge is detachably attached to the image forming apparatus body.

It is to be noted that the process cartridge B of the invention has, as a combination, a toner frame 11 having a toner container 11*a* for containing toner, and a developing frame 12 holding a developing means, such as a developing roller 9*c*. The process cartridge is structured in integrating with a photosensitive drum 7, a cleaning means 10 constituted of such as a cleaning blade 10*a*, and a cleaning frame 13 attaching a charging roller 8.

This process cartridge B is formed with an exposing opening 1*e* for radiating light corresponding to image information to the photosensitive drum 7 and a transfer opening 13*a* for rendering the photosensitive drum 7 face to a recording medium 2. More specifically, the exposing opening 1*e* is formed at the cleaning frame 13, and the transfer opening 13*a* is formed between the developing frame 12 and the cleaning frame 13.

FIRST EMBODIMENT

Figure 2:
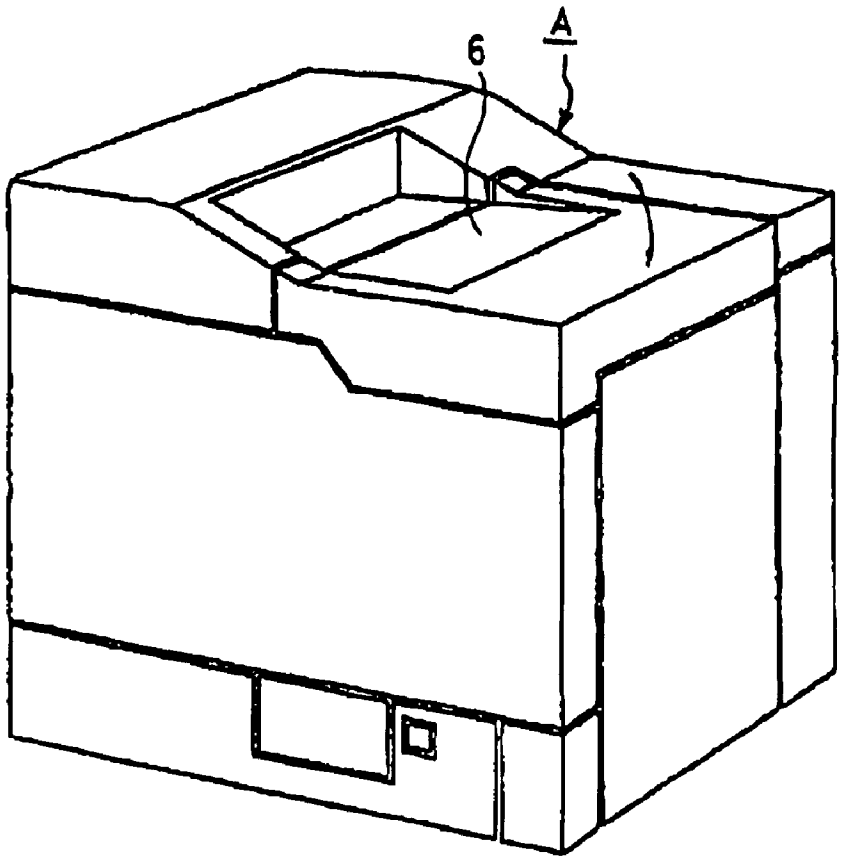
FIG. 2 is a perspective view showing an appearance of an image forming apparatus (laser beam printer) on which the process cartridge having the developing apparatus is mounted.
Figure 3:
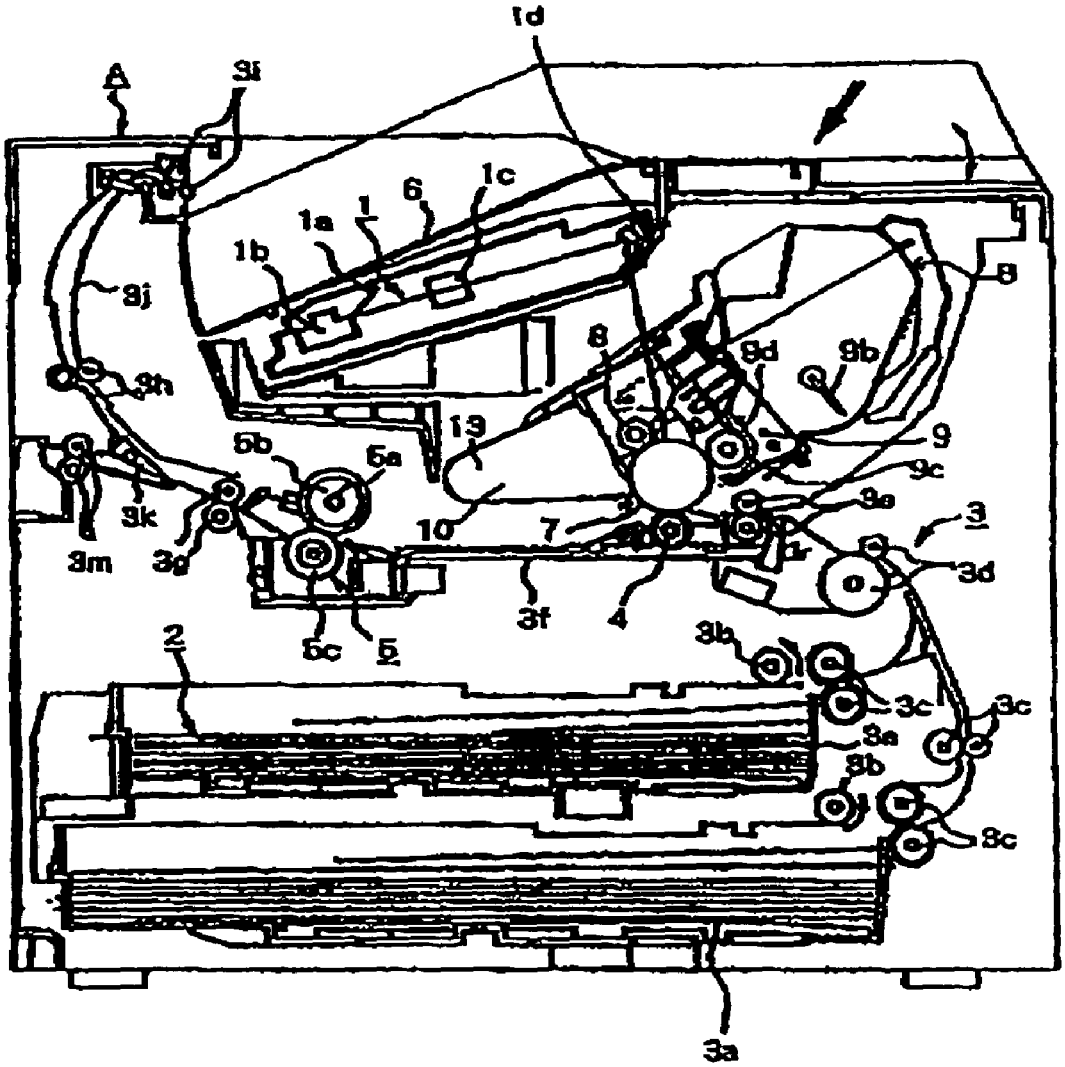
FIG. 3 is a structural illustration showing the image forming apparatus.

FIG. 1 is a diagram showing a process cartridge incorporating a developing apparatus according to the invention; FIG. 2 is a perspective view showing an appearance of an image forming apparatus (laser beam printer) to which this embodiment applies; FIG. 3 is a structural illustration showing the image forming apparatus.

Image Forming Apparatus

First, referring to the drawings, a laser beam printer A as an image forming apparatus to which this embodiment of the invention applies, is described. This laser beam printer A is, as shown in FIG. 3, for forming images on recording media, e.g., recording paper, OHP sheets, fabrics, through an electrophotographic image forming process. Toner images are formed on a drum-shaped electrophotographic photosensitive body (hereinafter referred to as "photosensitive drum 7").

More specifically, as shown in FIG. 1, charging is made uniformly on the photosensitive drum 7 with the charging roller 8 as a charging means at the process cartridge B. It is to be noted that this charging roller 8 is driven to rotate as contacting with the photosensitive drum 7. Laser beam corresponding to the image information out of an optical system 1 as shown in FIG. 3 is subsequently radiated to the photosensitive drum 7 through the exposing opening 1*e* to form latent images. It is to be noted that the optical system 1 includes a laser diode 1*a*, a polygon mirror 1*b*, and a lens 1*c*, and a reflection mirror 1*d*.

The latent images are developed with the developing means 9 in use of toner. The developing means 9 feeds the toner in the toner container 11*a* to the developing roller 9*c* serving as a developing agent carrier by rotation of a toner conveyance member 9*b*. The toner is supplied to the developing region of the photosensitive drum 7 upon rotating the developing roller 9*c* incorporating a stationary magnetic and upon forming, on the surface of the developing roller 9*c*, the toner layer to which triboelectric charges are given by the developing roller 9*c*. The toner is transferred to the photosensitive drum 7 corresponding to the latent image, thereby visualizing the toner images. A developing blade 9*b* herein is to restrict the toner amount on the peripheral surface of the developing roller 9*c* as well a to apply the triboelectric charges. A toner stirring member 9*e* is attached rotatably around the developing roller 9*c* to circulate the toner in the developing chamber.

Meanwhile, as shown in FIG. 3, in synchrony with formation of the toner images, the recording medium is conveyed by a conveying means 3. That is, the recording medium 2 set in a feeding cassette 3*a* is reverse conveyed with a pickup roller 3*b*, conveyance roller pairs 3*c*, 3*d*, and a registration roller pair 3*e*.

Subsequently, the toner image formed on the photosensitive drum 7 included in the process cartridge B is transferred to the recording medium 2 by application of a voltage to a transfer roller 4 as a transferring means. Remaining toner on the photosensitive drum 7 after transfer operation is removed by the cleaning means 10. The cleaning means 10 scrapes the toner remaining on the photosensitive drum 7 by an elastic cleaning blade 10*a* formed in contact with the photosensitive drum 7 and collects the toner into a waste toner reservoir 10*b*.

The recording medium 2 on which the toner image is transferred is conveyed to a fixing means 5 with a conveyance guide 3*f*. The fixing means 5 has a drive roller 5*c* and a fixing roller 5*b* incorporating a heater 5*a*. The transferred toner image is fixed upon application of heat and pressure to the passing recording medium 2.

The recording medium 2 is conveyed with delivery roller pairs 3*g*, 3*h*, 3*i*, and is delivered to a delivery tray 6 through a reversing route 3*j*. The delivery tray 6 is formed on a top surface of the image forming apparatus A as shown in FIG. 2. It is to be noted that after the images are fixed a pivotally movable flapper 3*k* can operate to delivery the recording medium 2 by a delivery roller pair 3*m* without passing through a reverse route 3*j*. In this embodiment, the conveying means 3 is constituted of the conveyance roller pairs 3*c*, 3*d*, the registration roller pair 3*e*, the conveyance guide 3*f*, the delivery roller pairs 3*g*, 3*h*, 3*i*, and the delivery roller pair 3*m*.

Toner's Sealing Member Around the Developing Roller

Figure 4:
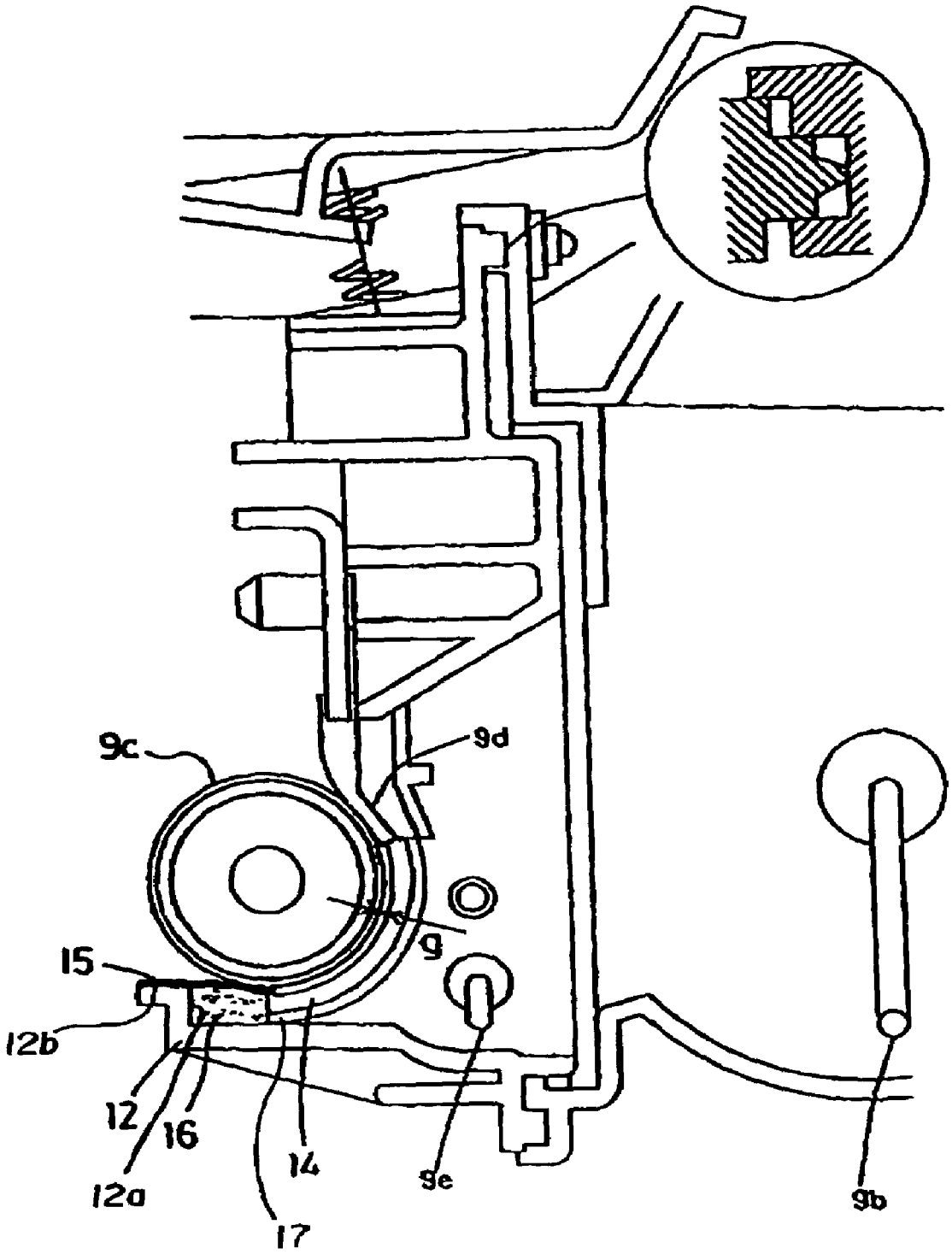
FIG. 4 is a cross section showing a developing frame of the process cartridge.
Figure 5:
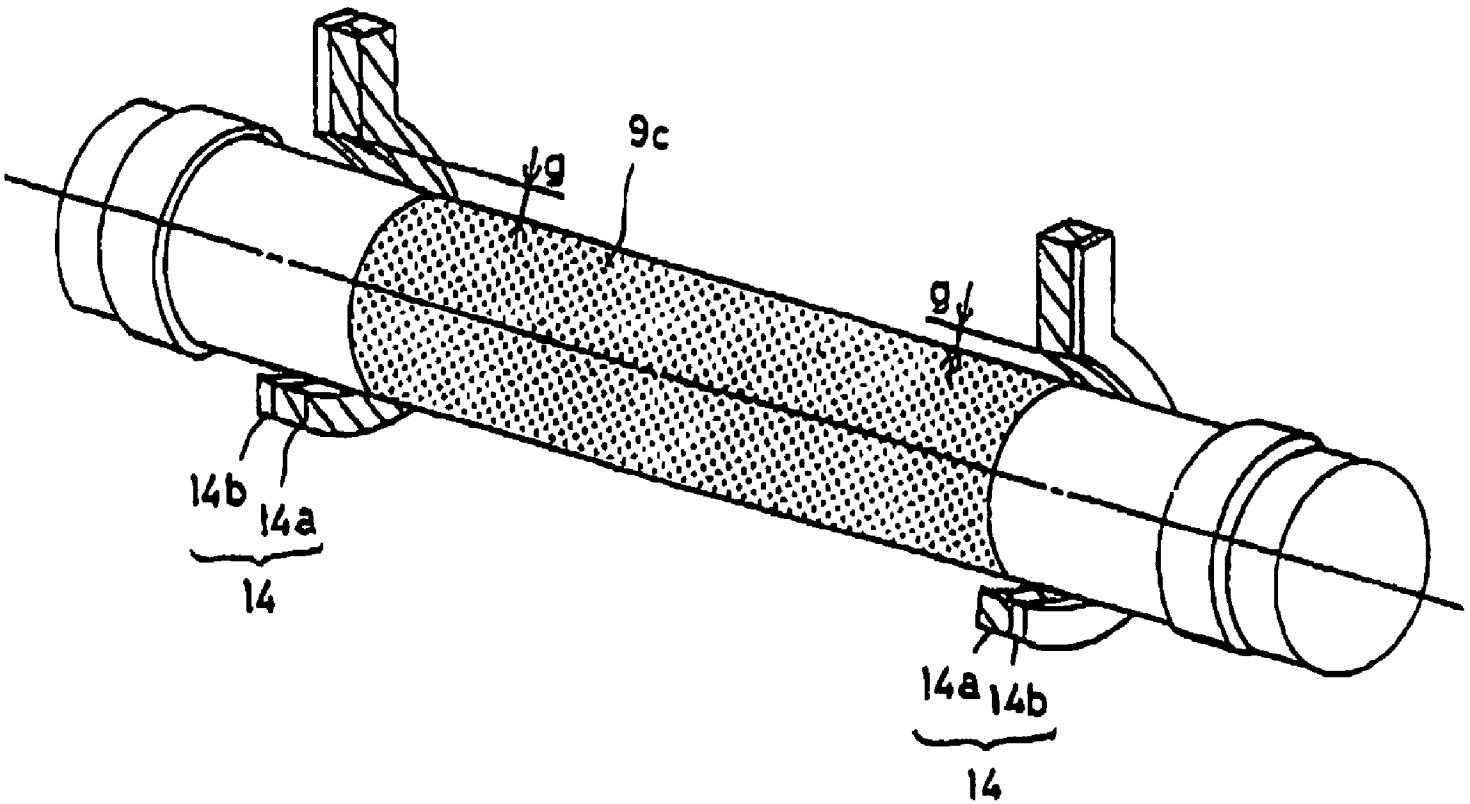
FIG. 5 is a diagram showing a positional relation between a developing roller and a magnetic sealing member.
Figure 6:
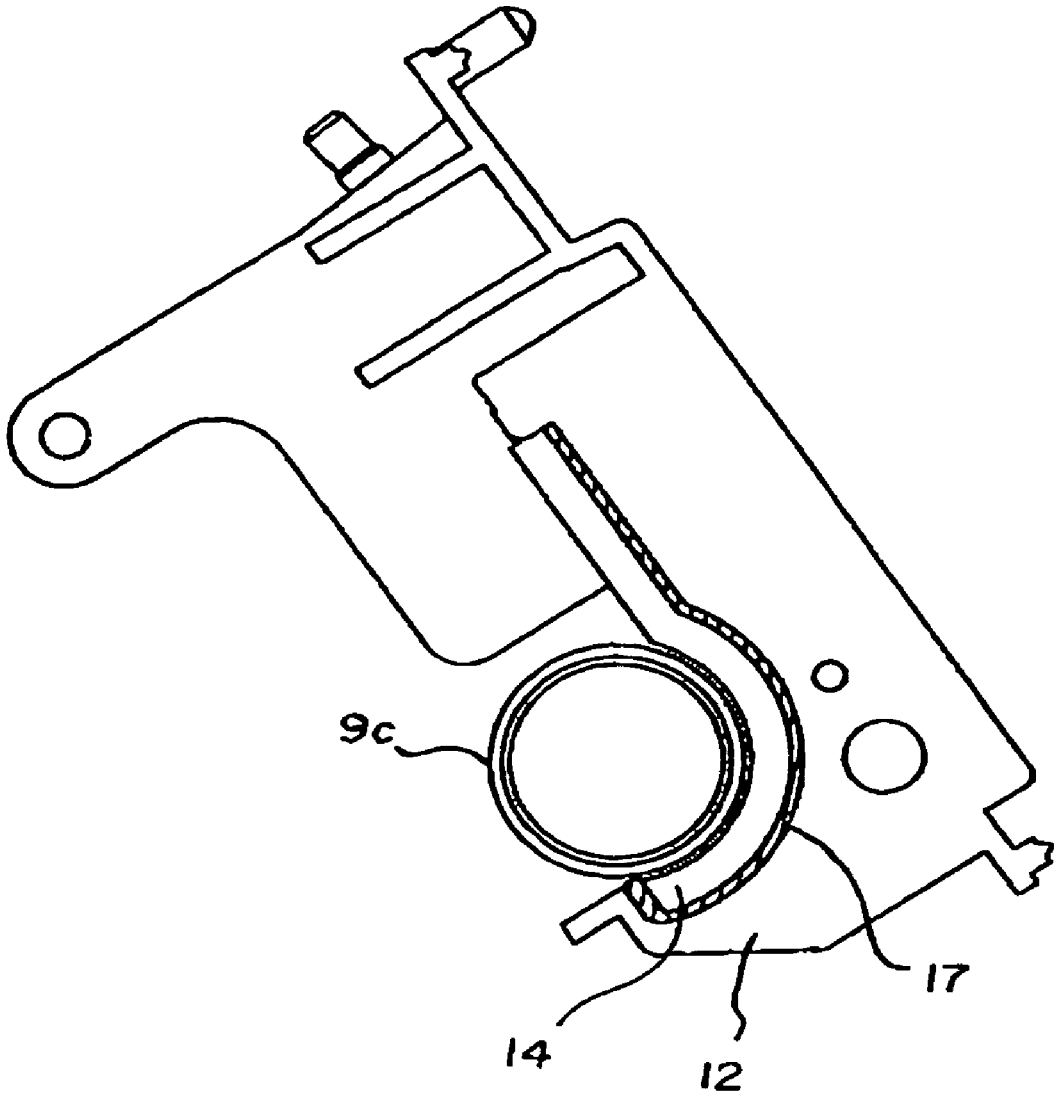
FIG. 6 is a cross section showing a positional relation between the developing roller and an end sealing member.
Figure 7:
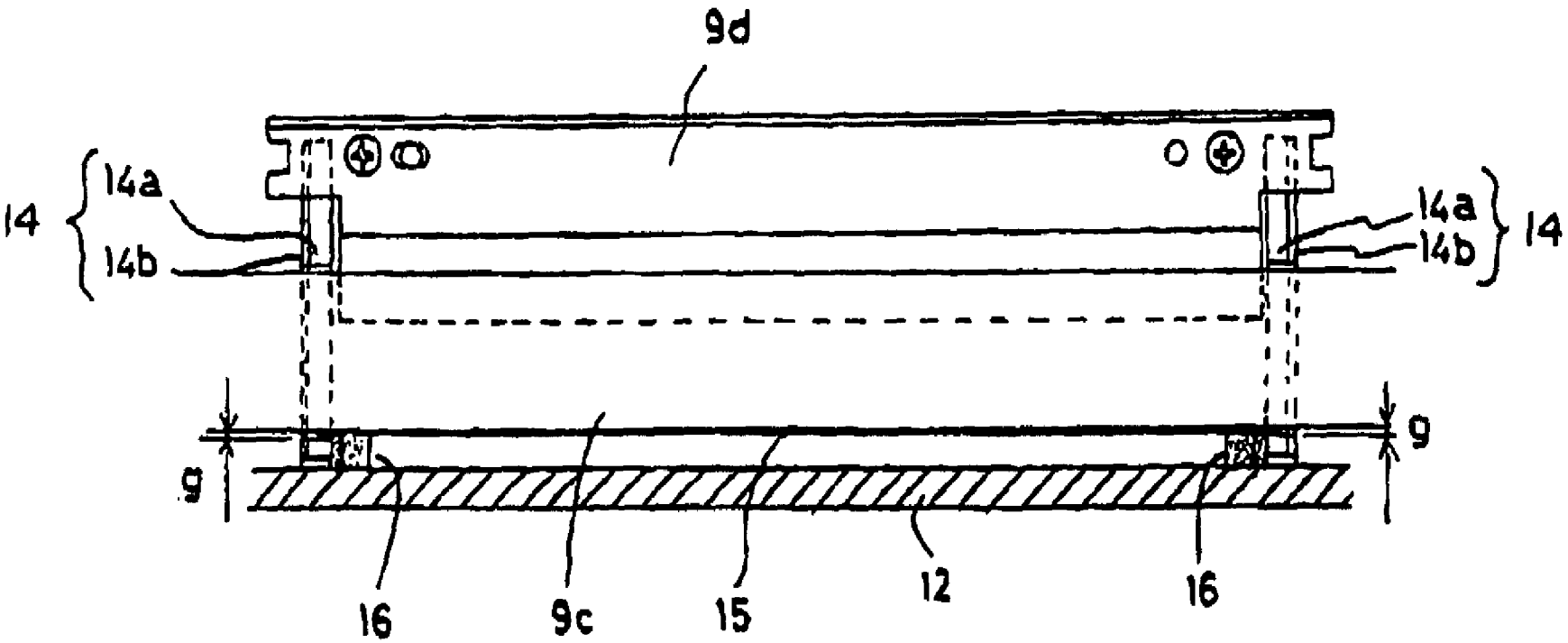
FIG. 7 is an illustration showing a positional relation among the developing roller, an elastic sheet, and a sheet lower sealing member.
Figure 8:
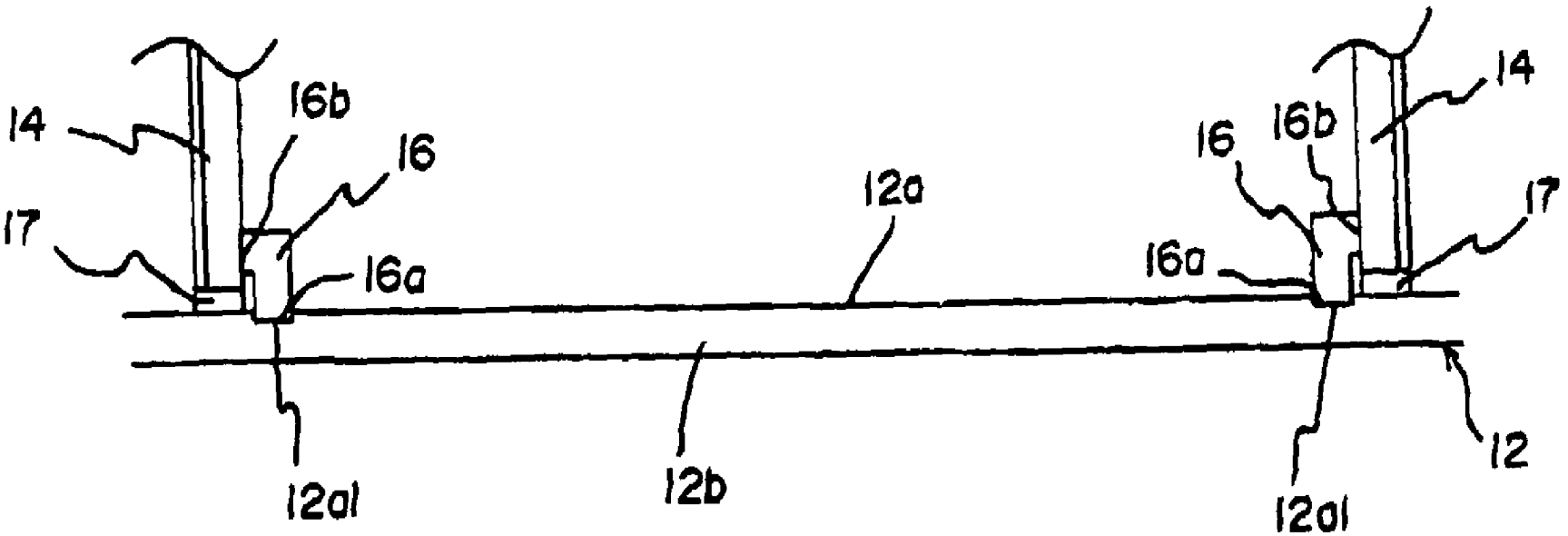
FIG. 8 is an illustration showing the layout and shape of the sheet lower sealing member according to the first embodiment.

Next, referring to FIGS. 4 to 8, a sealing member for toner around the developing roller 9*c* is described in detail. FIG. 4 is a cross section showing a developing frame of the process cartridge when viewed in a direction toward the end of the developing roller from a center portion in the longitudinal direction; FIG. 5 is a diagram showing a positional relation between the developing roller and a magnetic sealing member; FIG. 6 is a cross section showing a positional relation between the developing roller and an end sealing member; FIG. 7 is an illustration showing a positional relation among the developing roller, an elastic sheet (sheet member), and a sheet lower sealing member (auxiliary member); FIG. 8 is an illustration showing the layout and shape of the sheet lower sealing member according to the first embodiment.

A magnetic sealing member 14 is disposed at the opposite ends of the developing roller 9*c*. The magnetic sealing member 14 is disposed with a gap g to an outer peripheral surface of the developing roller 9*c* and is mounted on the developing frame 12. The magnetic sealing member 14 is made from a magnetic plate (magnetic member) 14*b* connected to an outer side surface of a magnet 14*a* in the longitudinal direction of the developing roller 9*c*.

The magnetic sealing member 14 is further described in detail now. The magnetic sealing member 14 has the magnet 14*a* as one structural element made of an injection molded product having a width of 3 mm with a nylon binder including of Nd—Fe—B magnetic powder, and the magnetic plate 14*b* as another structural element made of an iron material having a thickness of 1 mm. Connection between the magnet 14*a* and the magnet plate 14 is formed by an insertion molding of the injection molding. The connection, however, can be made with adhesive, double-sided adhesive tape, or attraction force connection solely from magnetic force. The gap between the developing roller 9*c* and the magnetic sealing member 14 is of 0.1 to 0.7 mm, and the magnetic flux density of the surface of the developing roller 9*c* at that time is about 1000 to 2000 G from the magnetic force of the magnetic sealing member 14. The positional relation between the magnet 14*a* and the magnetic plate 14*b* is that the magnet 14*a* is placed on an inner side in the longitudinal direction of the developing roller whereas the magnetic plate 14*b* is placed on an outer side.

As other sealing members, the elastic sheet (sheet member) 15 made of, e.g., PET or urethane is arranged at the developing frame 12 along the longitudinal direction below the developing roller 9*c*, and the tip portion (free end) thereof is in elastic contact with the developing roller 9*c*. The end of the elastic sheet 15 in the longitudinal direction of the developing roller is overlapped with the magnetic sealing member 14, and is within the width of the magnetic sealing member 14 (see, FIG. 7). The tip portion of the elastic sheet 15 at that position is located within the gap g between the developing roller 9*c* and the magnetic sealing member 14. That is, an end of the tip of the elastic sheet in the longitudinal direction of the developing roller enters in a space between the developing roller and the magnetic sealing member. As shown in FIG. 6, an elastic body portion 17 made of a material, such as sponge, rubber or the like, is formed on a side closer to the developing frame with respect to the magnetic sealing member 14. That is, the magnetic sealing member has a magnet portion facing to the peripheral surface of the developing roller and an elastic body portion facing to the container side.

As shown in FIG. 7, the sheet lower sealing member (auxiliary member) 16 made of a rubber sponge material is arranged on an inner side of the magnetic sealing member 14 in the longitudinal direction of the developing roller. The sheet lower sealing member 16 is, as shown in FIG. 8, in a letter-L shape when viewed from a top side (an upper side in FIG. 4), and one side 16*a* of the letter-L is disposed at a recess 12*a*1 in a side wall 12*a* attaching the elastic sheet of the developing frame 12. The other side 16*b* is disposed as extending to a portion at which the elastic sheet 15 comes in contact with the developing roller 9*c* below the elastic sheet 15, and contacts to the inner side of the magnetic scaling member 14 in the longitudinal direction of the developing roller.

Thus, because a part 16*a* of the sheet lower sealing member (auxiliary member) 16 enters in the recess formed at the container attaching the elastic sheet (sheet member) 15, this apparatus can restrict the toner from passing through the gap between the auxiliary member and the developing frame (container). In addition, because the sheet lower sealing member 16 is disposed as extending from the recess to a lower portion of a position at which the developing roller 9*c* and the elastic sheet 15 are in contact with each other where the recess is formed in the side wall 12*a* of the developing frame 12, the elastic sheet 15 is used for aiding the contact to developing roller 9*c* in a wide range, thereby preventing the toner from leaking due to entry of the toner between the elastic sheet 15 and the developing roller 9*c* and due to opening of the gap between the elastic sheet 15 and the developing roller 9*c* near a portion at which the toner is deposited. By forming the sheet lower sealing member into the letter-L shape, it is prevented that the contact pressure of the elastic sheet to the developing roller is increased too much to remove the toner on the developing roller.

Attaching Method of Elastic Sheet (Sheet Member) 15

Figure 9:
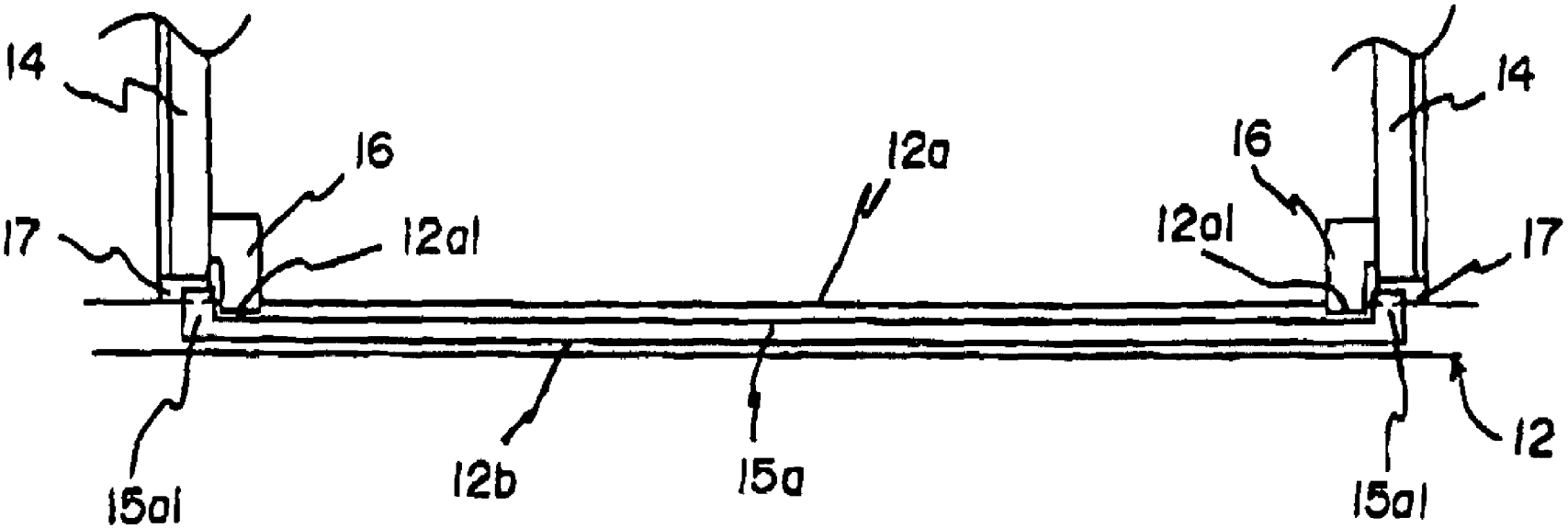
FIG. 9 is an illustration showing a state before the elastic sheet is attached to the developing frame of the first embodiment.
Figure 10:
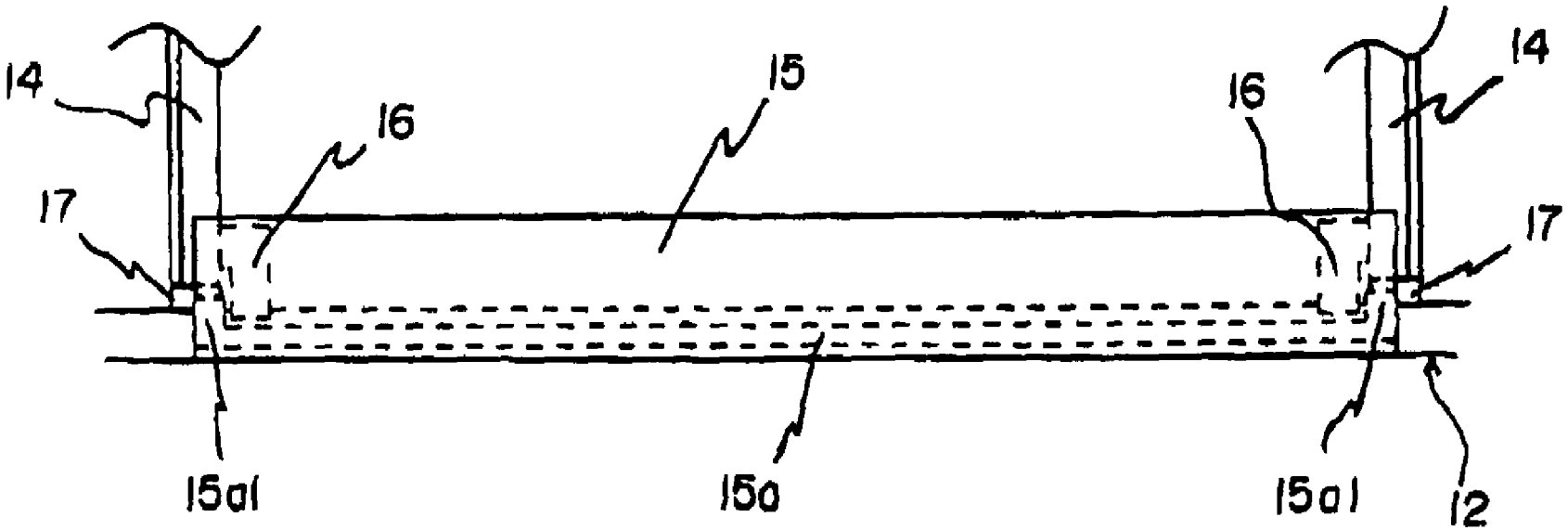
FIG. 10 is an illustration showing a state after the elastic sheet is attached to the developing frame of the first embodiment.

Next, attachment of the elastic sheet 15 to the developing frame 12 is described. FIG. 9 is an illustration showing a state before the elastic sheet is attached to the developing frame; FIG. 10 is an illustration showing a state after the elastic sheet is attached to the developing frame. As shown in the drawings, the elastic sheet 15 is attached to an attaching surface 12*b* of the developing frame 12 by a double-sided adhesive tape 15*a*. The double-sided adhesive tape 15*a* is designed to extend longer toward the sheet front end side at the opposite end portions in the longitudinal direction so as to overlap with an elastic body 17 between the magnetic sealing member 14 and the developing frame 12, or namely, an elastic body formed at the magnetic sealing member on a side of the developing frame. Therefore, the end of the double-sided adhesive tape in the longitudinal direction is in a letter-L shape.

With the above structure, the end in the longitudinal direction of the elastic sheet 15 contacting to the developing roller 9*c* does not separate from the developing roller by the toner existing in the gap g between the magnetic sealing member 14 and the developing roller 9*c*, so that the elastic sheet can made contacting to the developing roller stably. This apparatus also prevents the toner from leaking to the exterior of the developing frame 12 upon an entry of the toner through a space between the sheet lower sealing member 16 and the wall 12*a*1 on the side of elastic sheet attaching surface of the developing frame 12, or namely a space between the sheet lower sealing member 16 and the magnetic sealing member 14 in the longitudinal direction of the developing roller. The double-sided adhesive tape 15*a* of the elastic sheet 15 is overlapped to the end sealing member 17, so that leaking of the toner to the exterior of the developing frame between the end sealing member 17 and the elastic sheet 15 is surely prevented.

SECOND EMBODIMENT

Figure 11:
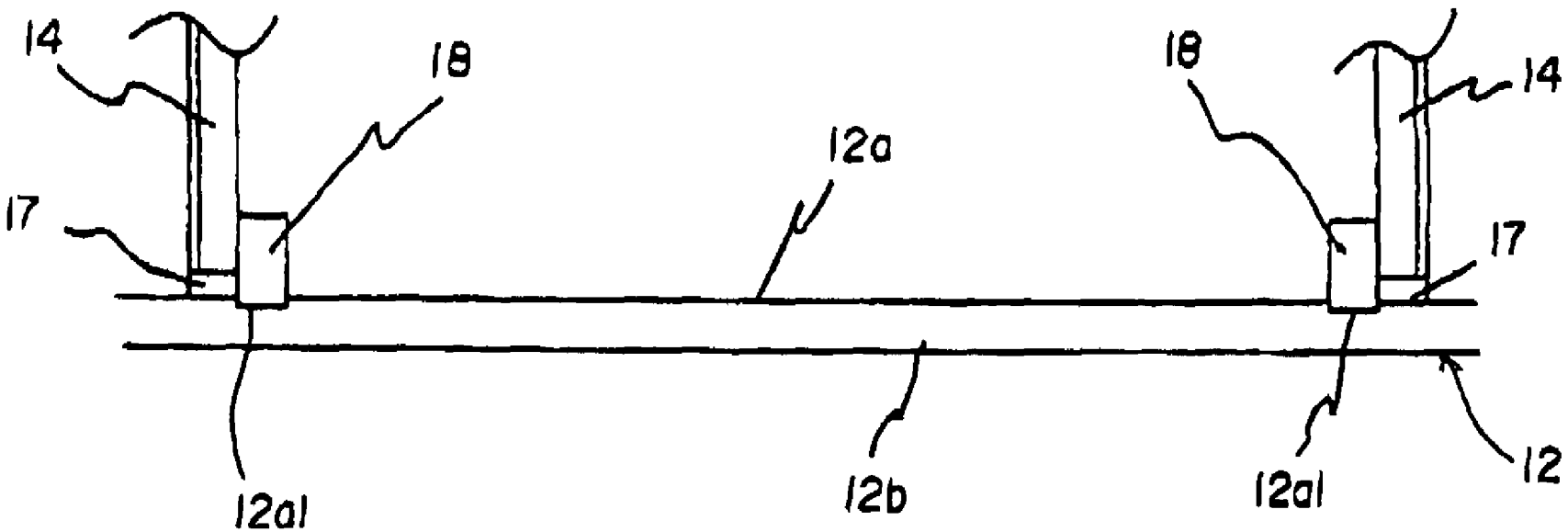
FIG. 11 is an illustration showing the layout and shape of the sheet lower sealing member according to the second embodiment.
Figure 12:
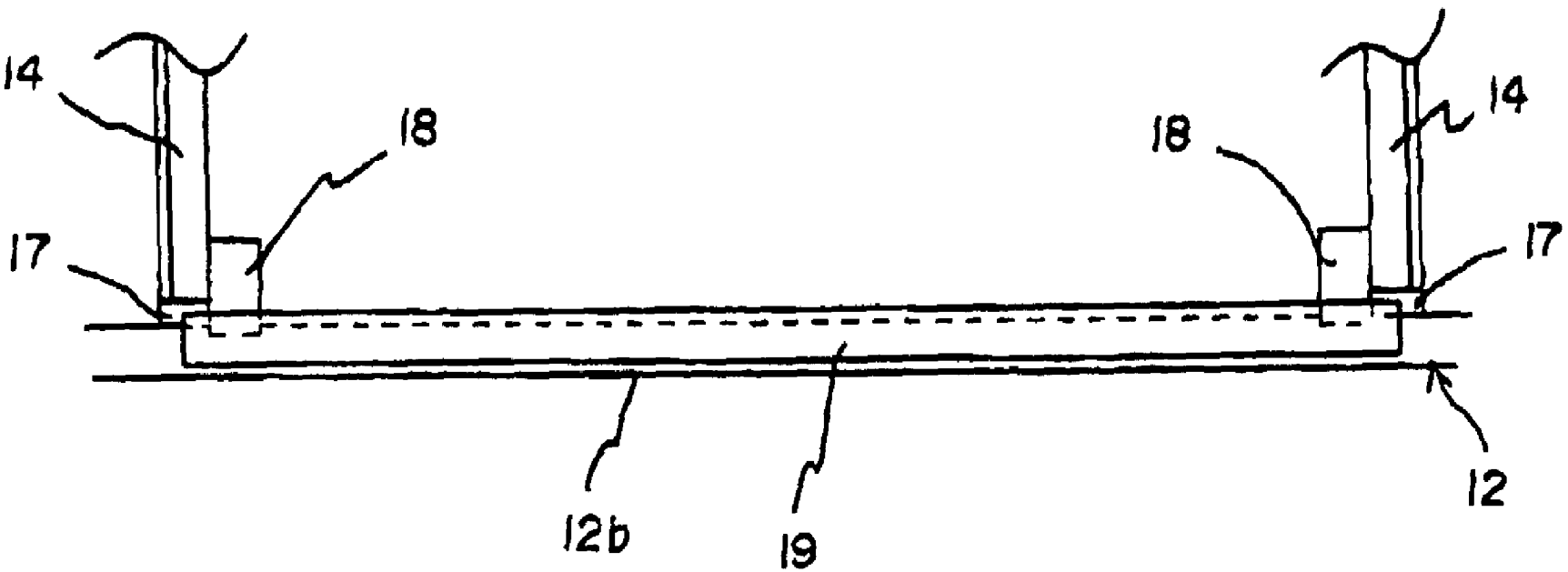
FIG. 12 is an illustration showing a state before the elastic sheet is attached to the developing frame of the second embodiment.
Figure 13:
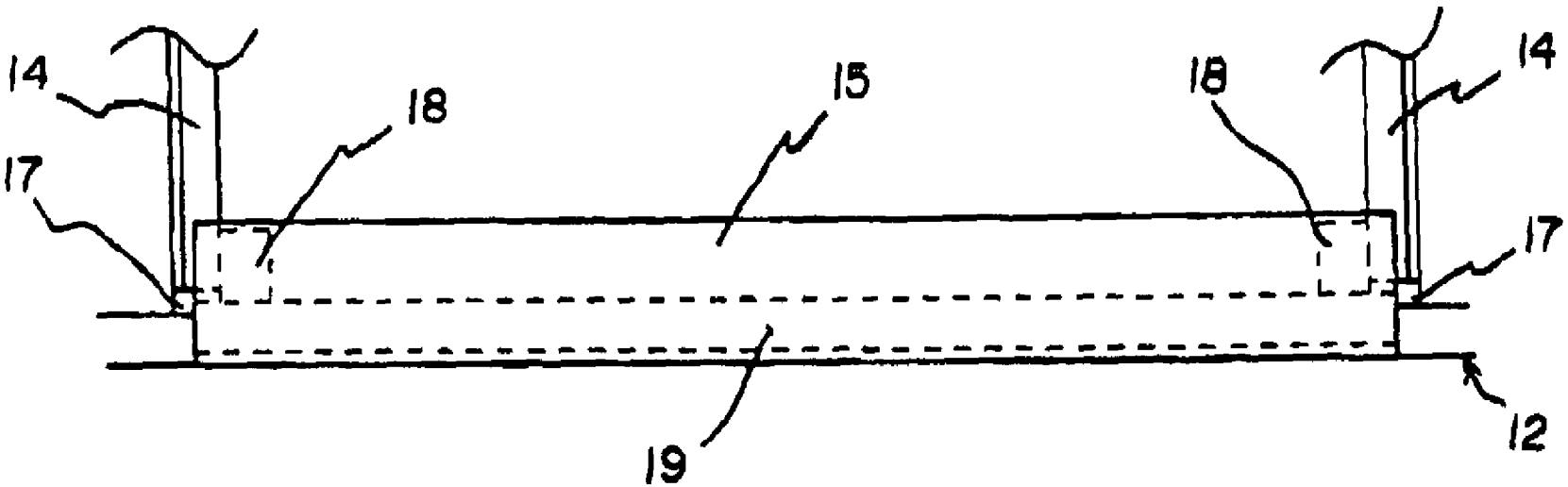
FIG. 13 is an illustration showing a state after the elastic sheet is attached to the developing frame of the second embodiment.
Figure 14:
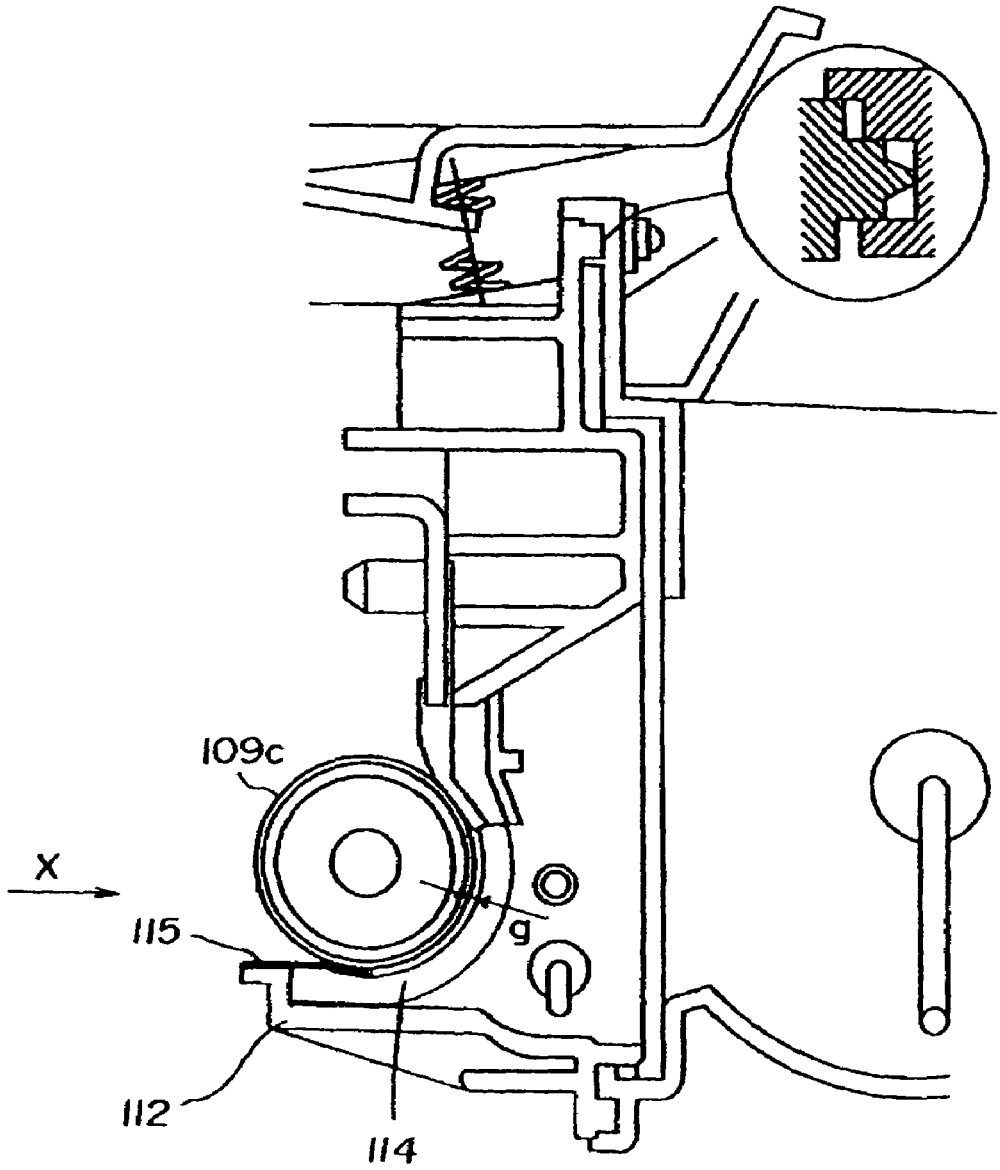
FIG. 14 PRIOR ART
FIG. 14 is a cross section showing a developing frame of a prior art.
Figure 15:
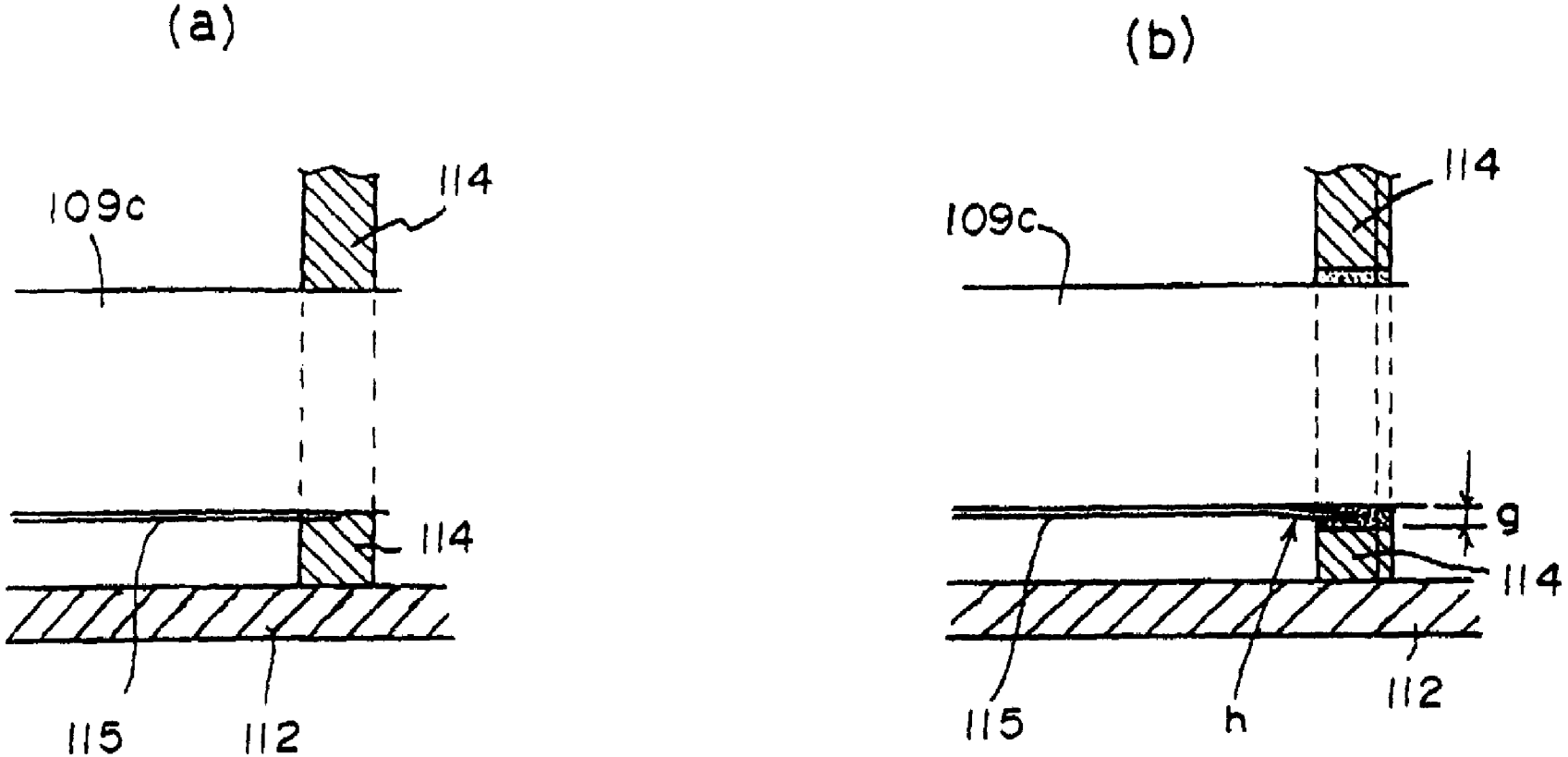
FIG. 15 PRIOR ART
FIG. 15 is a diagram showing an end of a developing roller when viewed from an arrow X direction in FIG. 14.

Next, the second embodiment of the invention is described in reference with FIG. 11, FIG. 12, and FIG. 13. FIG. 11 is an illustration showing the layout and shape of the sheet lower sealing member; FIG. 12 is an illustration showing a state before the elastic sheet is attached to the developing frame; FIG. 13 is an illustration showing a state after the elastic sheet is attached to the developing frame. It is to be noted that a description about substantially the same structures to those in the first embodiment is omitted upon providing the same reference numbers.

Attaching Method of Elastic Sheet 15

Although in the first embodiment the sheet lower sealing member 16 is made in the letter-L shape as the auxiliary member, a sheet lower sealing member 18 as shown in FIG. 11 is in a square shape or rectangular shape when viewed from the top (upper side in FIG. 4) in this invention. A double-sided adhesive tape 19 as an attaching member for the elastic sheet 15 is extended longer toward the front end side of the elastic sheet 15 across the entire region in the longitudinal direction. In such a case, it should be so set that the elastic sheet does not remove the toner on the developing roller caused by too high contacting pressure of the elastic sheet to the developing roller. With this structure, substantially the same effect can be obtained.

This invention is not limited to the above embodiments and includes modifications within the technical conception.

What is claimed is:

1. A developing apparatus comprising:

a container containing a developing agent;

a developer bearing member, which bears said developing agent received from said container and provides the developing agent to a photosensitive drum;

a developing frame, which supports said developing bearing member;

a magnetic sealing member magnetically restricting leakage of the developing agent at an end of said developing apparatus in a longitudinal direction of said developer bearing member, wherein said magnetic sealing member is provided on said developing frame to form a gap with an outer surface of said developing bearing member, and wherein said magnetic sealing member includes a magnetic portion facing a peripheral surface of said developing bearing member and an elastic portion facing to a side of said developing frame; and an elastic sheet preventing the developing agent from leaking out of said developing apparatus, said elastic sheet being attached with a double-sided adhesive tape along the longitudinal direction of said developing frame, wherein said magnetic sealing member and said elastic sheet are overlapped with each other, and wherein an end in a longitudinal direction of said double-sided adhesive tape is L-shaped and contacts said elastic portion of said magnetic sealing member.

2. The developing apparatus according to claim 1, wherein an end in the longitudinal direction of a tip of said sheet member enters into a space between said developer bearing member and said magnetic sealing member.

3. The developing apparatus according to claim 1, further comprising an auxiliary member, which is located adjacent to said magnetic sealing member, for biasing a free end side of said elastic sheet to said developing bearing member, wherein said developing frame is provided with, at a portion attaching to said elastic sheet, a recess into which said auxiliary member enters.

4. The developing apparatus according to claim 3, wherein said auxiliary member is an elastic member.

5. The developing apparatus according to claim 3, wherein the free end side of said elastic sheet is in contact with said developer bearing member along the longitudinal direction.

6. The developing apparatus according to claim 3, wherein said auxiliary member is L-shaped.

* * * * *